US008567760B2

(12) United States Patent
Sindt

(10) Patent No.: US 8,567,760 B2
(45) Date of Patent: Oct. 29, 2013

(54) PRYING TOOLS

(76) Inventor: Jason Sindt, Portland, OR (US)

( * ) Notice: Subject to any disclaimer, the term of this patent is extended or adjusted under 35 U.S.C. 154(b) by 425 days.

(21) Appl. No.: 12/978,400

(22) Filed: Dec. 23, 2010

(65) Prior Publication Data

US 2011/0155979 A1 Jun. 30, 2011

Related U.S. Application Data

(60) Provisional application No. 61/290,497, filed on Dec. 29, 2009.

(51) Int. Cl.
*B25C 11/00* (2006.01)
*B66F 15/00* (2006.01)

(52) U.S. Cl.
USPC ..... 254/25

(58) Field of Classification Search
USPC ..... 254/18–21, 25, 28, 131; 81/45
See application file for complete search history.

(56) References Cited

U.S. PATENT DOCUMENTS

| | | | | |
|---|---|---|---|---|
| 389,384 | A | 9/1888 | Hebblethwaite | |
| 1,359,777 | A | 11/1920 | Wright | |
| 1,422,262 | A | 7/1922 | Hansen | |
| 1,747,053 | A | 2/1930 | Boy | |
| 2,207,443 | A * | 7/1940 | Schneider | 414/428 |
| 2,462,250 | A | 2/1949 | Andrews et al. | |
| 3,134,574 | A | 5/1964 | Reuterfors | |
| 3,310,288 | A | 3/1967 | Berry | |
| 3,583,673 | A | 6/1971 | Poskin | |
| 3,680,834 | A | 8/1972 | Holloway | |
| 4,531,716 | A | 7/1985 | Rish | |
| 4,691,427 | A | 9/1987 | Hill | |
| 5,031,881 | A | 7/1991 | Thurmston | |
| 5,459,917 | A * | 10/1995 | Smith | 29/426.5 |
| D386,057 | S | 11/1997 | Hreha | |
| 5,813,295 | A * | 9/1998 | Jensen, Jr. | 81/45 |
| 5,820,107 | A | 10/1998 | Hall | |
| 5,988,595 | A * | 11/1999 | DeVincent | 254/243 |
| 6,032,927 | A | 3/2000 | Atkinson | |
| 6,058,809 | A * | 5/2000 | Flanz | 81/45 |
| 6,224,035 | B1 | 5/2001 | Parkhe et al. | |
| D444,690 | S | 7/2001 | Bond | |
| 6,308,935 | B1 | 10/2001 | Rocheford | |
| 6,318,213 | B1 | 11/2001 | Hendrix et al. | |
| 6,733,001 | B2 | 5/2004 | Wagner | |
| 6,752,380 | B1 | 6/2004 | Taylor et al. | |
| D507,167 | S | 7/2005 | Richardson | |
| 6,913,246 | B1 | 7/2005 | Skatch | |
| 6,920,807 | B2 | 7/2005 | Bond | |

* cited by examiner

*Primary Examiner* — Lee D Wilson
*Assistant Examiner* — Jamal Daniel
(74) *Attorney, Agent, or Firm* — Mohr Intellectual Property Law Solutions, PC

(57) ABSTRACT

A prying tool suitable for staple removal includes an elongate shaft with prying member disposed at one or both ends, (each) having a flat section terminating in a serrated, distal edge, and forming an integral fulcrum between the shaft and the serrated edge. The distal edge consists of parallel, wedge-like teeth, separated by rounded notches, each tooth tapering along its length to a sharp point at the tip, which is rounded across its width. The taper may be achieved via a forward beveled surface on the top face of the tooth. The width of the tooth may also taper from the bottom to the top face, with the top edges rounded and/or beveled. The configuration allows a tooth to engage a staple, then gradually straighten and lift it by distributing upward force evenly thereto, reducing staple breakage, and the rounded notches prevent the staple legs from lodging in the tool.

20 Claims, 3 Drawing Sheets

10
100
102
104
106
108
112
12
14
16
18
20
22
24
26
110
120
122
124
126
128
130

PRYING TOOLS

RELATED APPLICATION

This application claims the benefit of U.S. Provisional Application No. 61/290,497, filed on Dec. 29, 2009, the entire disclosure of which is incorporated herein by reference for all purposes.

TECHNICAL FIELD

The disclosure relates generally to tools used for prying, and specifically to prying tools that include a prying member having a serrated edge formed of a plurality of wedge-like teeth which may be especially suitable for extracting staples from a surface material.

BACKGROUND

Tools for prying objects apart or for removing one object from another (such as a nail from a piece of wood) are quite common. Typically, a prying tool is of a robust metallic design and coarse construction, lending it high strength in most situations but not providing as much utility in situations where more careful movements are required.

Commonly, pry bars (or crowbars) are of elongated design, constructed of heavy-gauge steel and having one flattened end and one curved end with a flattened terminus. At either or both of the ends of the pry bar, the flattened portion may be configured with a notch for grasping and removing nails embedded in wood or other materials. Similarly, a hammer having a nail-removing claw may include a tapered slot configured to grasp a nail. In each case, the prying tool (be it a hammer, a pry bar, or another specialized tool) often utilizes the nail-grasping portion in conjunction with an integral fulcrum to lever a nail or other fastener out of the material in which it is lodged.

In many contexts, a pry bar, hammer, or other prying tool is used to remove fasteners other than nails. For example, in flooring removal applications, such as carpet removal, it is quite common for the carpet underlayment to have been fastened to the floor material (typically wood) with staples. Because the underlayment is usually a soft padding material (such as urethane foam), when it is removed, the fastening staples remain embedded in the floor material, requiring removal. Staple removal is a task that is becoming more common in many structural renovation and/or demolition projects, especially those in which the substrate material should remain intact, as staples replace nails and other types of fasteners as the fastener of choice in many tacking applications.

However, a traditional pry bar or hammer is often not the right tool for such a job, and the staple removal operation is left incomplete or is not accomplished efficiently. For example, the prying member of such a tool may be too large to engage the staple crown properly, such as to provide adequate leverage for removal. Additionally, if care is not used during staple removal with such a tool, one or both legs of the staple may break from the crown and remain lodged in the material, or the crown itself may snap, such as due to uneven distribution of upward force when leverage is applied, or lateral force when the tool engages the staple, and so forth.

As another option, a specialized staple-removal tool (or staple puller) may be utilized, yielding a potentially more effective removal operation. In this case, however, the specialized tool design may require additional labor cost, with the tradeoff for complete staple removal being a slower removal process.

Other factors complicating an efficient and expedient staple removal process includes erratic or non-uniform staple size, placement, density, and/or alignment over a given area, non-uniform crown clearance from the substrate material, and so forth. Also, in many applications, it is desirable to remove staples from a substrate material in a manner that not only leaves the substrate installed (such as wood flooring), but also preserves or minimizes damage to the surface thereof (such as if it is desired to re-use, or even refinish, the wood flooring).

SUMMARY

The prying tools of the illustrative embodiments shown and discussed herein each include an elongate shaft portion having a prying member disposed at one or both ends thereof, with the prying member having a flat section terminating in a serrated, distal edge formed by a plurality of specially configured teeth that are arrayed in parallel and are separated by a corresponding plurality of specially configured notches. More specifically, each of the plurality of teeth is wedge-shaped; that is, each tooth tapers over at least a portion of its length to a sharp point at the tip thereof, which includes a rounded, forward edge across its width. Moreover, the notch separating the bases of adjacent teeth is rounded. The configuration of the serrated edge (namely, the round-edged, wedge-shaped configuration of the teeth and the rounded nature of the notches therebetween) of the prying tool adapts it for use, for example, as an efficient staple removal device.

For example, the rounded forward edge of a given tooth may ease entry into a staple body by smoothly engaging the crown of a staple, and may also provide a self-aligning feature, for example if the tooth engages the staple body at an angle. The wedge shape of the teeth enable engagement of staple crowns with limited vertical clearance, staple crowns that are flush with the material in which the staple is engaged, and even embedded staple crowns. The rounded base of the notches prevents wedging of the staple legs in the notch.

Some embodiments further include serrated edges with additional configuration features. For example, in some embodiments, the wedge shape is achieved by means of the top face of each tooth being provided with a beveled surface. In such embodiments, the beveled surfaces of each of the plurality of teeth may be coplanar. Further in such embodiments, the bottom face of each tooth may be substantially planar, or flat, or otherwise not including a beveled surface. Also in such embodiments, the side faces connecting the top and bottom faces of each tooth may incline toward each other from the bottom face to the top face along at least a portion of its length, which may function to shape and straighten the staple as the tooth engages it, reducing the possibility of staple breakage due to bends in the crown or legs, and maximizing crown surface contact to more broadly distribute upward force applied thereto, also reducing the possibility of staple breakage as leverage is applied.

Further, the edges at which the top face of each of the plurality of teeth meets the side faces thereof may be radiused along at least a portion of its length, such as to more closely match the radiused inner corners of a staple where the legs extend downward from the crown, reducing shear stress as leverage is applied.

The prying member also forms an integral fulcrum between the shaft portion of the prying tool and the serrated edge thereof, for additional leverage, if necessary.

In some embodiments, the prying tool is substantially in the form of a hammer having a having a handle supporting a head with a striking element on one end and a claw element on the other such that the shaft portion of the prying tool is in the form of a hammer handle, but the prying member of the prying tool is in place of the claw element.

In some embodiments, the prying tool is substantially in the form of a pry bar having a central shank terminating in a hook element on one end and a flat, bent chisel element on the other, such that the shaft portion of the prying tool is in the form of a central shank, but the prying member of the prying tool is in place of the chisel element. In such embodiments, the pry bar may further include a hook element at the end of the central shank opposite that of the prying tool, haying a second flat section terminating in a second serrated, distal edge configured similarly to that of the prying member.

In some examples, the prying tool is substantially in the form of a screwdriver having a central shank terminating in a flat, chisel element on one end and a handle on the other end. The flat, chisel element is configured to both remove staples and to engage screws in a manner similar to conventional screwdrivers.

In some prying tool embodiments, a hook portion has inner and outer legs meeting at an apex and that extend in different transverse directions relative to the longitudinal axis of the shank portion, with the inner leg connecting the outer leg to the shank portion and a chisel portion at the second end extending away from the longitudinal axis of the shank portion in the same direction as the inner leg. The chisel portion terminates in a serrated terminating edge that includes a plurality of teeth arrayed in parallel, each having an inner face facing axially away from the shank portion, with each inner face including a beveled surface extending from a sharp point at the tip of the respective tooth along at least a portion of its length toward the base thereof. Each beveled surface is coplanar with the plane collectively formed by the tips of the plurality of teeth and the apex of the hook portion, which may allow the tool to be placed and moved laterally on a surface in an orientation in which the shank portion is supported above a flat surface by the beveled surfaces and the apex, for example so that the wedge-shaped forward edges of the teeth may engage staples in the material without gouging the surface thereof.

In such embodiments, when placed in such an orientation, the vertical clearance between the surface and the shank portion may be sufficient to prevent a user's hand grasping the shank portion from contacting the surface. Such embodiments may further include a projecting region of the outer leg that extends beyond the axis of the shank portion that is adapted to provide a surface against which a user may apply lateral force when the prying tool is supported on a flat surface. Such embodiments may further include, on the outer leg of the hook portion, a second serrated terminating edge configured similarly to that of the chisel portion, for example for use of the tool in other orientations. Optionally, the chisel portion of such embodiments may include a bent region as it extends away from the axis of the shank portion such that the bent region provides an integral fulcrum between the shank portion and the serrated edge of the chisel portion. The teeth of the serrated edge of the chisel portion (and/or that of the hook portion) may be configured as noted above.

The concepts and components listed above are clarified with reference to the accompanying drawings and detailed description below.

DETAILED DESCRIPTION

Figures 1, 2:
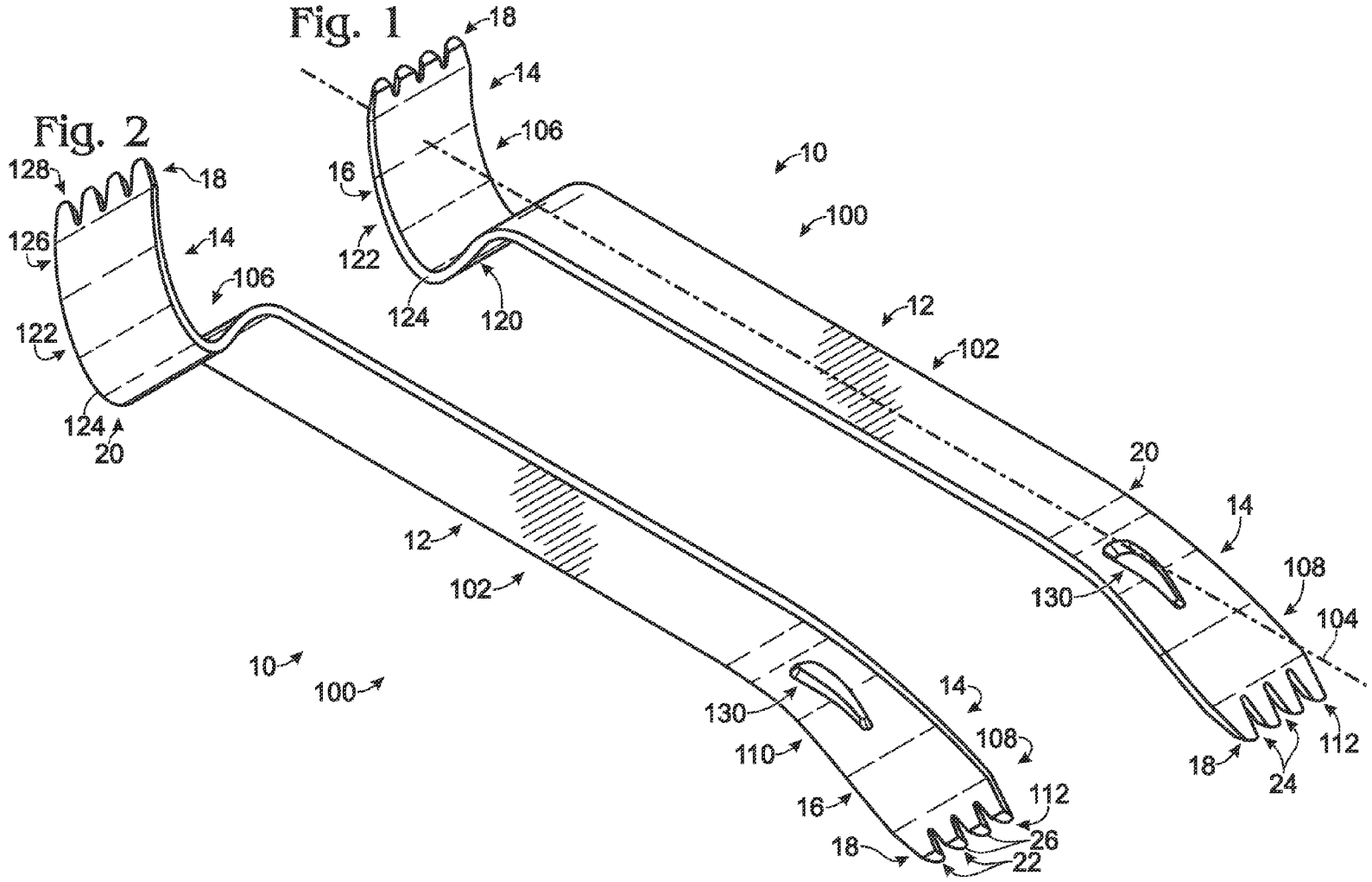
FIG. 1 shows an isometric view of an illustrative embodiment of a prying tool in accordance with the present disclosure, in the form of a pry bar having a chisel portion at one end and a hook portion at the other.
FIG. 2 shows an isometric view of the prying tool of FIG. 1, but inverted.

Referring to FIGS. 1-8, a first illustrative embodiment of a prying tool 10 in accordance with the present disclosure is illustrated as having a shape substantially in the form of a pry bar 100. As noted in more detail below, the prying tool in alternative embodiments consistent with this disclosure may take (and/or be incorporated into) other tool forms, such as a hammer, a screwdriver, and so forth.

Prying tools described herein may be used to remove a wide variety of staples, including flooring staples, roofing staples, and fencing staples, among many others. Some prying tool examples are configured to remove substantially all types of staples and other prying tool examples are specially configured to remove certain types of staples.

The numbering convention employed herein may indicate certain components or features among the various embodiments with more than one reference number, particularly in instances wherein the particular embodiment or configuration being described incorporates a given component in a specific form that may differ from the specific form that the component may take in a different embodiment or configuration. For example, a first embodiment of prying tool 10 is shown and described in the form of a pry bar 100, and a second embodiment is shown and described in the form of hammer 200. The prying tool 10 in all embodiments includes an elongate shaft portion that is indicated generally as 12, but which is indicated specifically in pry bar 100 as shank 102, and in hammer 200 as handle 202. For clarity, 100-level reference numbers are used in reference to pry bar 100, whereas 200-level reference numbers are used in reference to hammer 200.

Figures 6, 7, 8, 9:
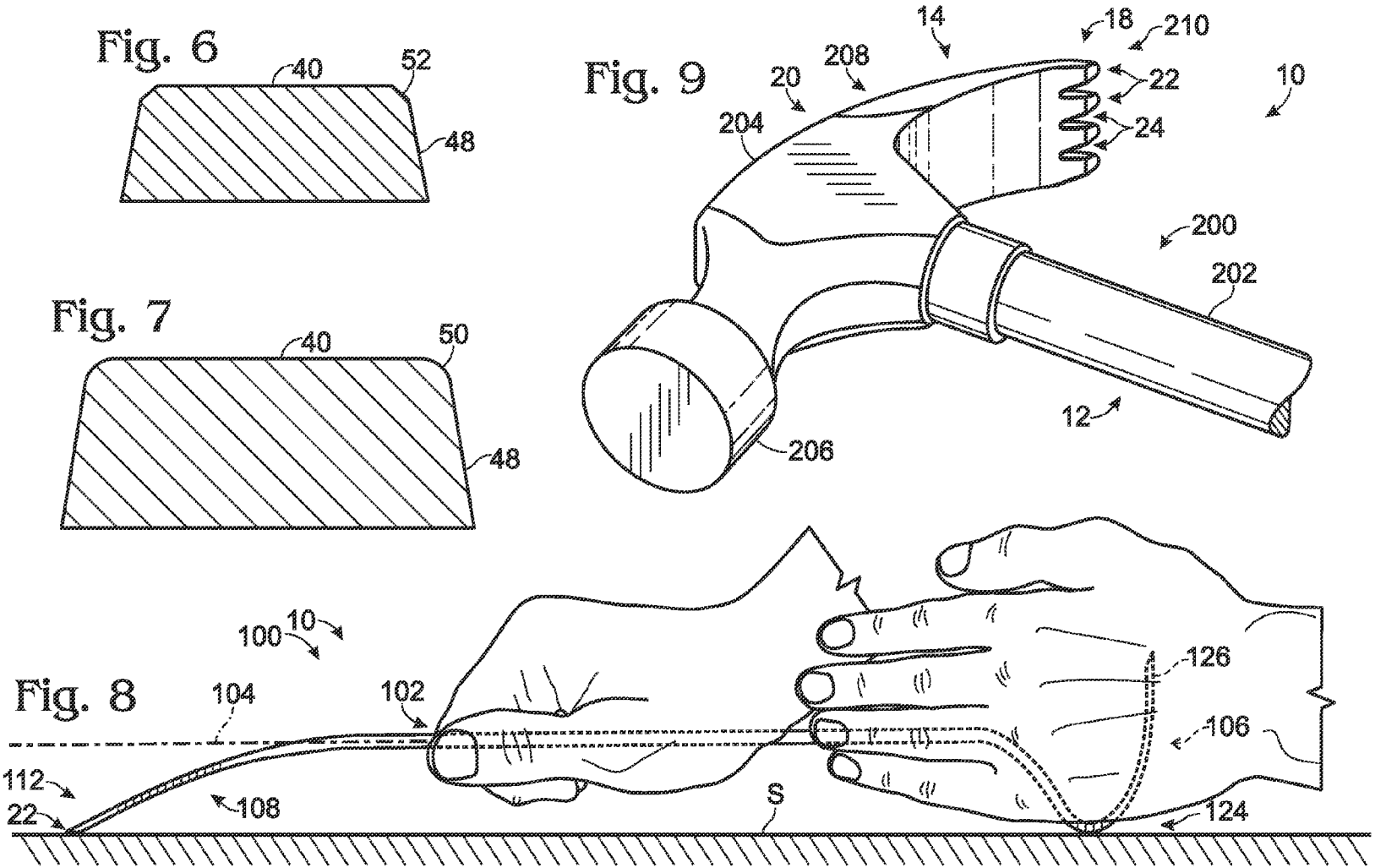
FIG. 6 shows a cross-sectional view of one of the teeth forming the serrated, terminal edge of the prying tool of FIG. 1, along the line 6-6 of FIG. 3.
FIG. 7 shows a cross-sectional view thereof, along the line 7-7 of FIG. 3.
FIG. 8 shows a side elevation view of the prying tool of FIG. 1.
FIG. 9 shows a partial isometric view of a second illustrative embodiment of a prying tool in accordance with the present disclosure, in the form of a hammer.

In the first illustrative embodiment of prying tool 10 as pry bar 100, the pry bar is shown, perhaps best in FIGS. 1, 2, and 8, to have an elongate shaft portion 12 in the form of a shank 102 extending along an axis 104. Prying tool 10 is shown to include, in this embodiment, a prying member 14 at either end of the elongate shaft portion 12, in the form of a hook portion 106 at a first end and flat chisel portion 108 at a second end. The pry bar 100 is formed from a flat bar having a comparatively constant cross-section across a majority of its length, with the width thereof increasing symmetrically at the ends, which are integral with the shank. However, as will be apparent to the skilled artisan, the shank portion (and/or one or both end portions) may have a differently-shaped cross-section, may assume different dimensions and/or proportions than as shown, and/or may be of composite construction instead of unitary.

The pry bar 100, as is typical of standard crowbars and the like, is constructed of a high-strength metal, such as hardened steel or steel alloy (for example, a high carbon steel such as SAE 1095), although any appropriate material providing high strength and durability may be used. Likewise, the prying tools constructed in accordance with the present disclosure, or any component parts thereof, may be formed of any appropriately strong, durable material or combination of materials.

Returning to FIGS. 1 and 2, both of the prying members 14 of the prying tool 10 are shown to include a flat section 16 terminating in a serrated, distal edge 18, with an integral fulcrum 20 formed between the shaft and each distal edge. More specifically, in the pry bar embodiment indicated at 100, the flat chisel portion 108 extends away from the axis 104 in a transverse direction relative thereto, defining a bent region 110 and terminating in a serrated, terminating edge 112. The hook portion 106 may be thought of as including an inner leg 120 and an outer leg 122 meeting at an apex 124, and extending in different transverse directions relative to the axis 104 of the shank portion, with the inner leg connecting the outer leg, via the apex, to the shank portion. More specifically, the inner leg bends away from the axis 104 in the same direction as the chisel portion 108, and the outer leg extends in an opposing direction. As can be seen perhaps most clearly in FIG. 8, the outer leg includes a projecting region 126 that intersects and extends beyond the longitudinal axis 104, approaching an axis perpendicular thereto, and terminating in a second serrated, terminating edge 128.

Overall, the shape of pry bar 100 allows either terminating edge to be maneuvered into an operable prying position, permitting leverage to be exerted by means of manipulating the shank portion about the integral fulcrum 20 formed by the bent region 110 or the portion collectively formed by the outer leg 122 and the apex 124, respectively. Additionally, although not required to all embodiments, pry bar 100 is shown to include a nail puller 130, which is a standard feature of many flat pry bars.

The distal edges 18, in the form of first and second terminating edges 112, 128, of the illustrative pry bar 100, are shown to be similarly configured, in that each is formed of a plurality of teeth 22 arrayed in a parallel formation and separated by a corresponding plurality of notches 24.

Figure 4:
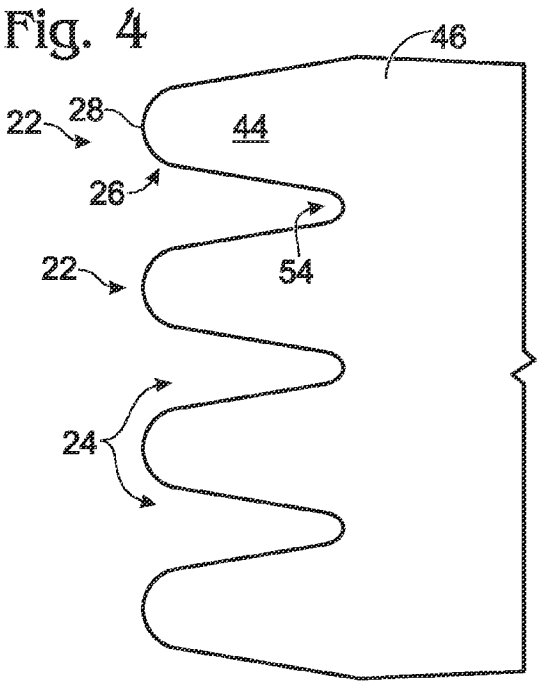
FIG. 4 shows a bottom plan view thereof.
Figure 5:
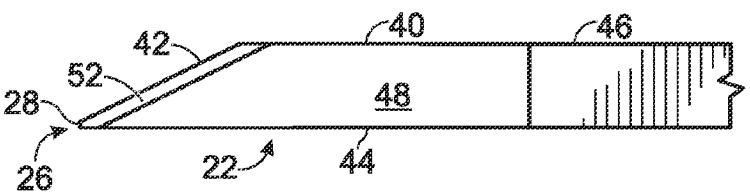
FIG. 5 shows a side elevation view thereof.
Figure 3:
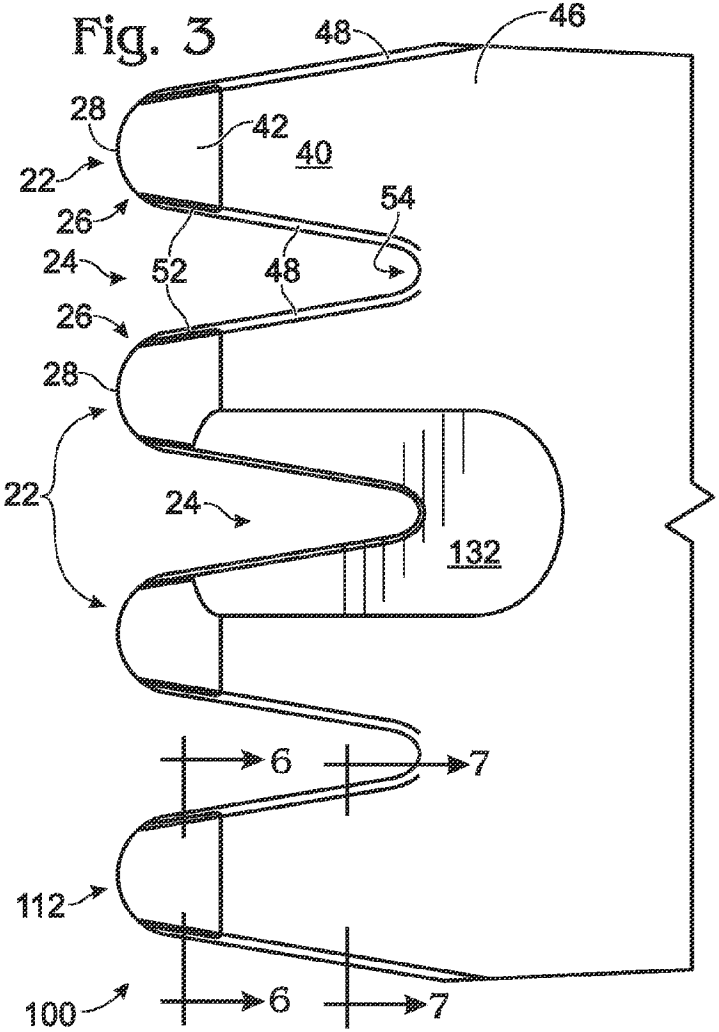
FIG. 3 shows a top plan view of the serrated, terminal edge of the chisel portion of the prying tool of FIG. 1.

As shown in FIGS. 3-5, the teeth 22 forming the serrated edges of the first and second terminating edges 112, 128, taper over at least a portion of their lengths to a sharp point at the tips 26 thereof, and include a rounded, forward edge 28 across their widths, giving each tooth a wedge-like shape. More specifically, in the illustrated configuration, each tooth is shown on one face 40 to include a beveled area 42, but is flat (i.e., non-beveled) on the opposing face 44.

For convenience and for the sake of clarity of illustration, the face of a tooth that features the beveled area 42 may be thought of as the top or inner face 40, and the opposing face may be thought of as the bottom or outer face 44. Thus, in the pry bar embodiment of prying tool 10, the top or inner faces 40 of teeth 22 face axially toward axis 104, whereas the bottom or outer faces 44 face axially away from axis 104.

Considered in different terms, but with reference to the pry bar embodiment, the top or inner faces 40 of teeth 22 are those disposed on the concave sides of the hook and chisel portions, and the bottom or outer faces 44 of teeth 22 are those disposed on the convex sides. Of course, these terms are used only for clarity rather than in a limiting sense. Moreover, other configurations and/or embodiments may include beveled areas on opposing faces of each tooth, or more than one beveled area on one or more faces.

In the illustrated embodiments and in the variations discussed herein, the wedge-like shape of teeth 22 of prying tool 10, and more generally the overall configuration of the serrated distal edge(s) of the prying member(s) of the prying tool, allows the tool to be used with fasteners of many different types. In particular, the teeth are suited for efficient staple removal, in that they are adapted to engage the crown of a staple embedded in a surface. Used in this context, the term "engage the crown" indicates that the tooth moves into the staple body, or in other words into the area below the staple crown and generally between the staple legs.

The pointed tip allows the tool to be used with staples having minimal vertical clearance or that are flush with the surface, with the wedge-like shape functioning to lever the crown upwards and away from the material as the tooth is moved further into the staple body. The rounded leading edge increases the possibility, in the event that a tooth contacts a leg of a staple instead of engaging the crown, that the tooth will be guided into the staple body rather than severing the staple leg, as lateral force is applied. The rounded leading edge may also function as a self-aligning feature, for example if a tooth initially engages the crown of a staple at an angle.

FIGS. 3-7 illustrate in greater detail an illustrative configuration of teeth 22, such as of terminating edge 112 of pry bar 100. In the pry bar embodiment shown in FIGS. 1-8, both terminating edges similarly configured, but this is not required to all of the prying tool embodiments, or even to all pry bar embodiments. In other pry bar configurations, for example, one edge may feature teeth of a different uniform size than the other, such as so that either end of the prying tool may be used with a different range of staple size or type.

Other variations include one end having a distal edge of a greater or smaller breadth than the other, one end having teeth that taper in a different manner than the other, and so forth. Moreover, it is not required to all pry bar embodiments that one end has a chisel formation whereas the other has a hook formation, as shown; rather, the prying member 14, and more particularly the configuration of the distal, serrated edge 18 thereof, may be incorporated into a variety of different pry bar configurations, as well as other tool configurations. Such variations are considered to be within the scope of this disclosure.

FIGS. 3 and 4 show plan views of the top faces 40, and bottom faces 44, respectively, of the teeth 22 of terminating edge 112 of pry bar 100, whereas FIG. 5 shows a side view thereof. Teeth 22 are each shown to extend from a base 46 to tip 26, and are arrayed in parallel, that is, with each tip oriented in the same direction. The teeth are also shown to be uniformly spaced, of uniform size, arranged so that the distal edge is straight (in that a line connecting the tip of each tooth is straight), and of tapering width from base to tip.

The various aspects of the tooth configuration, although not all required to all embodiments, may, either in individually or collectively, serve different purposes. For example, the tapering width of the teeth may assist in staple removal by shaping and/or straightening the legs of a staple engaged the by tooth as it is moved further into the staple body, which may in turn reduce the possibility of staple breakage due to bends in the legs (and/or crown), and maximize staple surface contact to more broadly distribute upward force applied thereto to further reduce the possibility of staple breakage as leverage is applied.

For similar reasons, the width of each tooth 22 is shown to taper from the bottom face to the top face; in other words, the side faces 48 of each tooth incline toward each other from the bottom face to the top face along at least a portion of its length. Further, as additionally shown in FIGS. 6 and 7, the top edges 50 of each tooth 22 (at which the top face 40 meets the side faces 48 thereof) are radiused along the majority of its length, and further include a beveled side region 52 along the beveled area 42 of each tooth. The radiused-edge feature may allow the tooth to more closely match the inner corners of a staple body where the legs extend downward from the crown (which are typically radiused), such as to reduce shear stress on the staple while increasing surface contact as the tooth moves further into the staple body and as leverage is applied.

The notches 24 separating the bases of adjacent teeth 22 are shown to be rounded. More specifically, the base 54 of each notch 24 is radiused, which may serve to prevent the leg (or other part of a staple) from becoming lodged in the notch, which would otherwise slow the pace at which the tool may be used. The manner of radiusing may be as desired; for example, the entire inner surface of the based of each notch may be continuously curved, or may include flat sections connected by radiused edges, and so forth. Also, the degree of radiusing of the notch base may be such that a staple leg (which is generally a thin, narrow metal plate), will not lodge therein, but the shank of a nail (which is typically of a thicker cross-section) may, which may provide the tool with versatility for different types of fasteners. To further this feature, the pry bar 100 includes a U-shaped recessed area 132 surrounding the central notch, such as to receive the head of a nail engaged in the notch.

The dimensions, proportions, and other physical characteristics of the teeth 22 may be as desired, for example to suit the tool for use with a particular staple size range, to optimize the tool's applicability to different staple removal applications, and so forth. For example, the length and taper of the teeth of the prying tool may optimize a trade-off between tool durability and reduced staple breakage. In prototype pry bar embodiments used for staple removal in carpet removal applications, it was found that teeth that tapered to about 40-60% of their base width at the rounded forward edge, over a length of about 100-150% of their base width, and having a thickness (i.e., the dimension from the top face to the bottom face) of about 8-15% of their base width, allowed users to remove staples in a manner that represented significant labor cost savings over prior methods (such as use of specialized tools such as staple pullers, or non-specialized tools such as standard crowbars of different sizes) without damage or degradation to the tool. In such prototype embodiments, approximately the forward-most 20-400 of the top face comprised the beveled area, with the bevel angle of the beveled area being between about 20 to 35 degrees relative to the surface of the flat section 16, and the bevel angle of the side faces being between about 70 to 85 degrees relative thereto.

In two example prototype pry bar embodiments using the aforementioned proportional ranges, the pry bars were 9 and 15 inches in length, respectively. Each featured a similarly configured serrated edge at a chisel end thereof, consisting (as shown in FIGS. 1-8) of four uniformly sized and spaced teeth separated by three notches, of approximately 1.75 inches in total breadth, with each tooth tapering from an approximately 0.44 inches wide base to approximately 0.22 inches at the point where the forward edge was rounded (at a radius of approximately 0.11 inches). Each tooth was approximately 0.55 inches from base to tip, with approximately the forward-most 30% comprising the beveled area, which was approximately 28 degrees relative to the surface of the surrounding flat section 16. At its base, each tooth was approximately 0.10 inches thick, and tapered, over the beveled area, to a sharp, forward edge at its tip. The staples removed were a variety of carpet staples with crown widths ranging from 3/16 inch to about 1/2 inch and leg lengths ranging from 3/8 inch to about 1/2 inch.

It is expected, however, that dimensions and/or proportions outside of these values and ranges would be suitable for numerous other staple-removal and fastener-removal applications, and such variations are considered to be within the scope of this disclosure. As a simple example of this concept, different size ranges of staples from those described above could be accommodated by proportionally scaling the dimensions of the teeth of either example prototype pry bar embodiments.

The angle of the beveled area may be a function, in different pry bar embodiments, of variables such as the extent of the deflection of the apex 124 from the longitudinal axis 102 of the shank portion, the angle and/or extent of deflection of the chisel portion therefrom, and so forth. For example, pry bar 100 is shown in FIG. 8 to be resting on a relatively flat, level surface S. As shown, the beveled areas of teeth 22 are configured to be coplanar with the plane collectively formed by the tips of the teeth and the apex of the hook portion. This feature may allow a user to move the tool laterally along the surface with the sharp points of the teeth engaged with the surface, as shown, but without gouging the surface as the tool is moved.

Moreover, as shown in FIG. 8, the particular configuration of this feature, in the illustrated embodiment, provides vertical clearance between the surface upon which the tool sits and the shank portion 102 that is sufficient to prevent a user's hand grasping the shank portion from contacting the surface, such as during use of the tool in this orientation.

For example, surface S may represent a surface (such as a wall or floor) from which staples are to be removed. In use, the prying tool 10 in the form of a pry bar 100 is typically moved laterally relative to the surface with the serrated, distal edge 18 of the prying member 14, for example the terminating edge 112 of the chisel portion 108 of the pry bar 100, engaged with the surface, such as so the teeth thereof may engage, and remove, staples. This may be done in two orientations: with the top face of the staples facing away from the surface ("top-up"), or with the top face of the staples facing toward the surface ("top-down"); in FIG. 8, the tool is shown in latter, top-down orientation. Each orientation may have different utility, depending on the nature of the staples to be removed, user preference, surface condition, and so forth.

For example, the pry bar tool in the top-up orientation is generally held with the hook portion raised from the surface in order to hold the sharp points of the teeth at or near the surface. This orientation may be useful for rapid removal of staples that are only partially embedded within the material, or in other words with the crowns spaced from the surface. Once a tooth engages the crown of a staple, lateral movement of the tool to move the tooth farther in to the staple body is, in many cases, sufficient to free the staple from the surface, due to the specially-configured tooth surfaces and the nature of the notches therebetween.

Indeed, in use, it is found that if the tool is moved to engage a staple crown with sufficient speed, the staple is, in many cases, freed from the surface material with sufficient force to propel it away from the surface (and the tool), without applying additional leverage. However, by moving the hook portion closer to or away from the surface, the user may also apply leverage, if desired or as necessary, to free a staple, for example if the legs of the staple are long and/or engaged with the surface at an angle, and so forth. In the top-up configuration, the angle of the teeth relative to the surface is freely adjustable, both when engaged with a staple and when not.

The top-down orientation illustrated in FIG. 8, on the other hand, may be suitable for an application in which it is desired that the tips are constantly engaged with the surface at a consistent angle. This may be a suitable position, for example, to prevent the teeth from inadvertently gouging the surface when the tool is moved laterally thereto. It may also be a suitable orientation to engage the teeth with staples that are more deeply embedded within the material, for example by lifting the hook portion slightly away from the surface in order to wedge the points of one or more teeth under the crown, then returning the apex to the surface and engaging the staple body more fully in order to remove the staple.

Providing the hook portion with a serrated edge that is similarly configured to that of the chisel portion may provide a user another option by which a greater amount of leverage may be applied, if necessary, to a staple engaged by one or more teeth. For example, a user may swing the hook portion toward the surface to engage the crown of a staple embedded therein, then continue the motion to use the integral fulcrum formed by the outer leg and the apex to apply a greater amount of leverage. This configuration may be particularly suited to remove, for example, staples with very long legs, or legs that include a heat-activated adhesive that form a chemical bond with the surface material in addition to a friction bond, and thus may require a considerable amount of force to remove. Although the 9-inch example prototype pry bar embodiment was found to be lighter and easier to flip around in a user's hand among the various orientations discussed above than the 15-inch example, both were found to have a great amount of utility in efficiently removing a variety of staples.

As mentioned above, various features of the pry bar embodiment 100 of the prying tool 10 may be varied from as shown and described herein. For example, although pry bar 100 is shown to include both a hook and a chisel portion that both include a prying member 14 having a flat section 16 terminating in a serrated, distal edge 18, other pry bar embodiments may feature differently-configured portions into which one or more prying members may be incorporated.

Moreover, the illustrated pry bar embodiment 100, as well as alternative configurations of pry bar embodiments of prying tool 10, may be fabricated in any appropriate manner. For example, the pry bar may be fabricated by forging and casting methods. The example pry bar embodiments described above, for example, were formed by retooling suitable commercially-available pry bars. However, any suitable method of manufacture may be employed, for example by adapting a standard manufacturing process for a pry bar of a desired configuration to include additional steps in order to form the teeth-and-notches configuration of the distal, serrated edge(s) of the prying member(s), such as by waterjet cutting or any suitable technique.

The prying tool 10 may, as indicated above, take any other suitable form, such as that of a different traditional tool form (such as a hammer or a screwdriver), or forms that depart from traditional tool forms. The latter may allow the prying tool to be utilized in specialized applications, such as those with limited space constraints, for a specialized type of staple, to combine another feature with one or more prying members in the same tool, and so forth. FIG. 9, however, shows an example of the former, in which a prying tool 10 is shown in a second illustrative embodiment as hammer 200.

In the hammer embodiment, prying tool 10 has an elongate shaft portion 12 in the form of a hammer handle 202 terminating at one end in a hammer head 204, which in turn has a striking element 206 disposed on one end and a prying member 14, in the form of a claw portion 208, on the other. Claw portion 208 is shown to bend toward the handle 202 as it extends away from the head 204, forming an integral fulcrum 20 of the prying tool, and terminating in a flat section 16 that features a serrated, distal edge 18 in the form of a terminating claw edge 210. The terminating claw edge 210 is shown to be formed in a manner similar to the terminating edges of pry bar 100; that is, it includes a plurality of wedge-like teeth 22 arrayed in parallel and separated by a corresponding plurality of rounded notches 24.

In use of the prying member 14 of the pry tool 10 in the hammer embodiment, the terminating claw edge may be used to extract staples in a manner similar to the terminating edge of the hook portion of the pry bar 100: by grasping the handle to swing the edge toward a staple, engaging the staple crown with one or more teeth, then continuing the motion to lever the staple free of the material in which it is embedded.

In the screwdriver embodiment, the prying tool includes, as with a conventional screwdriver, a handle, an elongate shank, and a head portion. Advancing the design of conventional screwdrivers, the head portion on the screwdriver prying tool defines a flat, chisel section with a plurality of wedge-like teeth. The wedge-like teeth are arrayed in parallel and separated by a corresponding plurality of rounded notches. The screwdriver embodiment has been found to be especially suitable for hard to reach staples and for light-duty staple removal.

To some extent, the configuration of the prying member(s) of various embodiments of a prying tool may be constrained, determined, or otherwise a function of, the overall configuration and/or form the tool takes. As an example, the example pry bar embodiments discussed above featured prying members with serrated edges approximately 1.75 inches in total breadth, consisting of four equally-sized teeth arrayed in a straight line. The breadth of the claw portion of a standard hammer is generally narrower, being approximately 1 to 1.25 inches in breadth. Of course, hammer embodiment could be provided with a serrated edge of any desired breadth, but use of a serrated edge having a breadth consistent with that of a standard hammer's claw portion may ease use of the serrated edge because a user would likely be familiar with a breadth of an expected dimension on a hammer. As such, it a serrated edge having a narrower breadth is used, it may be formed of a fewer number of teeth, or smaller teeth, as compared with those of the dimensions described in the example pry bar embodiments.

Of course, in any form of the prying tool, the configuration of the prying member may be as desired, and this many variations are possible, some of which may be more aptly suited to particular applications than others. One example variation is providing the serrated edge of a prying member with a greater or lesser number of teeth than as shown and described in the illustrated embodiments, and/or teeth of a different size. Another example variation is providing the serrated edge of a prying member with teeth of non-uniform character—such as nonuniformly spaced, sized, or otherwise configured teeth. For example, a prying member may include a serrated edge having small, closely-spaced teeth along one section of the serrated edge, and larger, widely-spaced teeth along another, such as to provide a tool usable with a variety of staple size ranges. The beveled areas of the teeth may be divergent along the edge; that is, the beveled areas of one set of teeth on a serrated edge may be disposed on the top face of the teeth, whereas a second set of teeth on the serrated edge may be disposed on the bottom face. Further, the biased areas of the teeth on a serrated edge may take different configurations, and/or the teeth may taper evenly from base to tip, on one or both faces, instead of featuring a beveled area on only one face. As mentioned love, these variations, and others, be incorporated into a prying tool constructed in accordance with this disclosure, such as to optimize a trade-off between convenience or utility, and durability, and/or to adapt the tool to a specific application or type of staple, and so forth.

Although the present invention has been shown and described with reference to the foregoing operational principles and illustrated examples and embodiments, it will be apparent to those skilled in the art that various changes in form and detail may be made without departing from the spirit and scope of the invention. The present invention is intended to embrace all such alternatives, modifications and variances that fall within the scope of the appended claims.

I claim:

1. A prying tool, comprising:

an elongate shank having a first and a second end;

a hook portion at the first end having inner and outer legs meeting at an apex and extending in different transverse directions relative to the longitudinal axis of the shank portion, with the inner leg connecting the outer leg to the shank portion; and a chisel portion at the second end extending away from the longitudinal axis of the shank portion in the same direction as the inner leg, the chisel portion terminating in a serrated terminating edge that includes a plurality of teeth arrayed in parallel;

wherein each of the plurality of teeth has an inner face facing axially away from the shank portion, each inner face further including a beveled area extending from a sharp point at the tip of the respective tooth along at least a portion of its length toward the base thereof; and wherein each beveled area is coplanar with the plane collectively formed by the tips of the plurality of teeth and the apex of the hook portion.

2. The prying tool of claim 1, wherein when placed on a flat surface with the shank portion supported relative thereto by the beveled surfaces and the apex, the vertical clearance between the surface and the shank portion is sufficient to prevent a user's hand grasping the shank portion from contacting the surface.

3. The prying tool of claim 1, wherein the width of each of the plurality of teeth tapers from base to tip.

4. The prying tool of claim 1, wherein the base of each of the plurality of notches is rounded.

5. The prying tool of claim 4, wherein the surface of the flat portion surrounding at least one of the plurality of notches is configured to receive the head of a nail.

6. The prying tool of claim 4, wherein the inner surface of the base of each notch is continuously curved.

7. The prying tool of claim 4, wherein the inner surface of the base of each notch includes flat sections connected by radiused edges.

8. The prying tool of claim 1, wherein the chisel portion includes a bent region as it extends away from the longitudinal axis of the shank portion, the bent region forming an integral fulcrum between the shank portion and the serrated terminating edge of the chisel portion.

9. The prying tool of claim 1, wherein:

the serrated terminating edge defines a first serrated terminating edge; and the hook portion includes a flat section terminating in a second serrated terminating edge comprising a plurality of teeth arrayed in parallel, separated by a corresponding plurality of notches, and configured similarly to those of the first serrated terminating edge of the chisel portion.

10. The prying tool of claim 9, wherein the serrated hook portion of the prying tool includes a plurality of teeth of uniform size as that of the serrated chisel portion.

11. The prying tool of claim 9, wherein the second serrated terminating edge is substantially similar in breadth to the first serrated terminating edge.

12. The prying tool of claim 1, wherein the plurality of teeth are uniformly spaced along the serrated terminating edge.

13. The prying tool of claim 1, wherein the size of each tooth in the plurality of teeth along the serrated terminating edge is uniform.

14. The prying tool of claim 1, wherein the serrated terminating edge is straight.

15. The prying tool of claim 1, wherein the tool is substantially in the form of a hammer having a handle supporting a head with a striking element on one end and a claw element on the other, such that the elongate shank portion of the prying tool is in the form of a hammer handle, but the chisel portion of the prying tool is in place of the claw element.

16. The prying tool of claim 1, wherein the elongate shank portion includes a nail puller.

17. The prying tool of claim 1, wherein the tool is substantially in the form of a pry bar.

18. The prying tool of claim 17, wherein the edges at which the top face of each of the plurality of teeth meets the side faces thereof are radiused along at least a portion of its length.

19. The prying tool of claim 1, wherein each of the plurality of teeth includes a top face facing axially away from, and a bottom face facing axially toward, respectively, the longitudinal axis of the shank portion, and two side faces connecting the top and bottom faces; and wherein the side faces of each of the plurality of teeth incline toward each other from the bottom face to the top face along at least a portion of its length.

20. A prying tool, comprising:

an elongate shank portion having a first and a second end;

a hook portion at the first end having inner and outer legs meeting at an apex that protrudes in a transverse direction relative to the longitudinal axis of the shank portion and provides a supporting point when the prying tool is placed on a flat surface, with the inner leg connecting the apex and outer leg to the shank portion; and a chisel portion at the second end extending away from the longitudinal axis of the shank portion in the same direction as the apex, the chisel portion terminating in a serrated terminating edge that includes a plurality of teeth arrayed in parallel;

wherein each of the plurality of teeth has an inner face facing axially away from the shank portion, each inner face further including a beveled surface extending from a sharp point at the tip of the respective tooth along at least a portion of its length toward the base thereof;

wherein each beveled surface is coplanar with the plane collectively formed by the tips of the plurality of teeth and the apex of the hook portion;

wherein the apex protrudes from the longitudinal axis to provide sufficient vertical clearance, when the prying tool is supported on a flat surface by the apex and the serrated edge of the chisel portion, to prevent a user's hand grasping the shank portion from contacting the surface; and wherein the outer leg of the hook portion further includes a projecting region that extends beyond the longitudinal axis of the shank portion and approaches an axis perpendicular thereto, the projecting region being adapted to provide a surface against which a user may apply lateral force when the prying tool is supported on a flat surface.

* * * * *